US011111675B1

(12) United States Patent
Smith

(10) Patent No.: US 11,111,675 B1
(45) Date of Patent: Sep. 7, 2021

(54) FLASHING TOOL

(71) Applicant: David Smith, Cape Coral, FL (US)

(72) Inventor: David Smith, Cape Coral, FL (US)

( * ) Notice: Subject to any disclaimer, the term of this patent is extended or adjusted under 35 U.S.C. 154(b) by 0 days.

(21) Appl. No.: 16/726,218

(22) Filed: Dec. 23, 2019

Related U.S. Application Data

(60) Provisional application No. 62/784,428, filed on Dec. 22, 2018.

(51) Int. Cl.

| | |
|---|---|
| ***E04D 15/04*** | (2006.01) |
| ***B21D 5/00*** | (2006.01) |
| ***E04D 13/14*** | (2006.01) |
| ***B25G 1/10*** | (2006.01) |

(52) U.S. Cl.
CPC ..... *E04D 15/04* (2013.01); *B21D 5/002* (2013.01); *E04D 13/14* (2013.01); *B25G 1/102* (2013.01)

(58) Field of Classification Search
CPC .. B21D 5/002; B21D 5/16; B25D 7/02; E04D 13/14; E04D 15/04; B25G 1/102
See application file for complete search history.

(56) References Cited

U.S. PATENT DOCUMENTS 3,808,870 A * 5/1974 Blancett ..... B21D 15/02 72/413
4,403,497 A * 9/1983 Matteucci ..... B21D 5/16 72/409.16
D270,895 S * 10/1983 Holloway ..... B21D 15/02 D8/89
5,065,608 A * 11/1991 Skelton ..... E04D 15/04 72/409.01
5,222,386 A * 6/1993 Jones, Jr. ..... B21D 5/042 72/319
5,572,899 A * 11/1996 Balaity ..... B21D 5/0209 72/413
8,997,410 B1 * 4/2015 Starks, Jr. ..... E04D 15/04 52/127.2
9,016,102 B2 * 4/2015 Harvey ..... B25B 7/12 72/409.13
2002/0134971 A1 * 9/2002 Christensen ..... B66F 15/00 254/25
2011/0239555 A1 * 10/2011 Cook ..... F24S 25/40 52/173.3
2011/0259073 A1 * 10/2011 Musser ..... B25B 7/04 72/319

(Continued)

FOREIGN PATENT DOCUMENTS

CH 135269 A * 9/1929 ..... B21D 5/16

OTHER PUBLICATIONS

Machine translation for foreign reference CH135269, obtained from (https://translationportal.epo.org/emtp/translate/?ACTION=description-retrieval&COUNTRY=CH&ENGINE=google&FORMAT=docdb&KIND=A&LOCALE=en_EP&NUMBER=135269&SRCLANG=de&TRGLANG=en (last accessed on Dec. 8, 2020) (Year: 2020).*

(Continued)

*Primary Examiner* — Theodore V Adamos
(74) *Attorney, Agent, or Firm* — Underwood & Associates, LLC

(57) ABSTRACT

A tool for forming flashing is disclosed. The tool includes an elongate rod member, a handle member disposed on a first end of the rod member, and a spade member on a second end of the rod member opposite the first end, wherein the spade member includes first and second spades symmetrically disposed and having a gap therebetween.

8 Claims, 4 Drawing Sheets

(56) References Cited

U.S. PATENT DOCUMENTS

| | | | | |
|---|---|---|---|---|
| 2011/0271799 | A1* | 11/2011 | Fachorn | B25B 7/02 81/319 |
| 2012/0312413 | A1* | 12/2012 | Bullard | B21D 53/44 140/71 C |
| 2020/0324331 | A1* | 10/2020 | Tscheinig | B21D 19/08 |

OTHER PUBLICATIONS

Alfano, Sal, DIY Kickout Flashing, Aug. 22, 2016, https://www.proremodeler.com/diy-kickout-flashing (last accessed on Jun. 29, 2021) (Year: 2016).*

Engel, Andy, Bending Kick-out Flashing, Jun./Jul. 2014, https://www.finehomebuilding.com/project-guides/roofing/bending-kick-out-flashing (last accessed on Jun. 29, 2021) (Year: 2014).*

* cited by examiner

FLASHING TOOL

CROSS REFERENCE TO RELATED APPLICATIONS

This application claims priority to and the benefit under 35 USC § 119(e) of U.S. Provisional Patent Application No. 62/784,428 filed on Dec. 22, 2018, the contents of which are incorporated by reference in their entirety as if fully set forth herein.

TECHNICAL FIELD

This disclosure relates to tools and method for the formation of roofing flashing. In particular, this disclosure relates to a hand tool providing the ability to create roofing flashing, particularly kick-out and dormer flashing, from stock flashing substrate material.

BACKGROUND

Flashing generally refers to roofing components that aid in preventing water leakage where runoff occurs or where two opposing roof surfaces meet, such as roof valleys, the intersection of a dormer wall and a roof surface, chimneys and skylights. So-called "kick-out" flashing is a roofing component generally designed to divert water run-off at an angle from the roof or along an intersection of adjoining roof surfaces. Flashing is commonly made from galvanized steel; however, it may be formed from other materials such as rust-resistant aluminum or copper.

Flashing is generally inserted between roof or wall surfaces and shingles to divert water runoff to a gutter or other desired location. Flashing is commercially available in standard sizes and designs to fit common roof architectures. However, custom-made flashing is sometimes required when roofing a house of unique construction. In this case, flashing can be made by bending and shaping stock pieces of galvanized steel or other stock into a desired shape.

Generally, roofers are exposed to danger by virtue of the heights that they work. Forming stock pieces of steel on a roof can place roofers in further danger because doing so may require cutting stock to form three-dimensional pieces, which exposes sharp edges and can increase the risk of damaging the existing roof. Furthermore, this process may lead to distraction, may require sharp tools, may otherwise present further danger of falling, and can be time consuming.

A tool predisposed to quickly and easily forming desired flashing pieces would reduce the likelihood of the above-mentioned injuries, reduce the amount of time required to form such pieces (and thus reduce the amount of time roofers need to spend at height) and reduce the cost to the homeowner by avoiding expensive, pre-formed flashing pieces. Accordingly, development of a flashing tool is an unmet need in the construction industry, particularly in the housing and roofing sector.

SUMMARY

In one general aspect, a roofing tool is disclosed. The roofing tool is predisposed to the formation of custom flashing pieces, such as kick-out and dormer flashing, the shape of which is controllable by the user.

In one exemplary embodiment, a flashing tool includes a handle portion and a spade portion. The spade portion is configured to receive a portion of stock flashing material (e.g., a square of galvanized steel). Upon turning the handle, which is connected to the spade portion, the stock flashing material is formed into a shape that is suitable for installation as kick-out roof flashing.

In one exemplary aspect, a tool for forming flashing is disclosed. The tool includes an elongate rod member, a handle member disposed on a first end of the rod member, and a spade member on a second end of the rod member opposite the first end, wherein the spade member includes first and second spades symmetrically disposed and having a gap therebetween.

Certain advantages of the systems and methods disclosed herein include a tool that rapidly and easily forms roof flashing; reduction in the amount of time a roofer needs to remain at height while installing flashing; cost reduction compared to commercially-available flashing; the ability to make right- or left-handed flashing components without changing tools; the reduction of potential injury from cutting stock pieces (e.g., with tin snips or similar instruments); a reduction in the number of tools a roofer needs to form custom flashing components; and reduced likelihood of injuries due to falls by reducing distractions while operating on the roof; among others.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

The foregoing summary is illustrative only and is not intended to be in any way limiting. In addition to the illustrative aspects, embodiments, and features described above, further aspects, embodiments, and features will become apparent by reference to the drawings and the following detailed description and claims.

DESCRIPTION OF DRAWINGS

The present embodiments are illustrated by way of the figures of the accompanying drawings, which may not necessarily be to scale, in which like references indicate similar elements, and in which.

DETAILED DESCRIPTION OF ILLUSTRATIVE EMBODIMENTS

Figure 1:
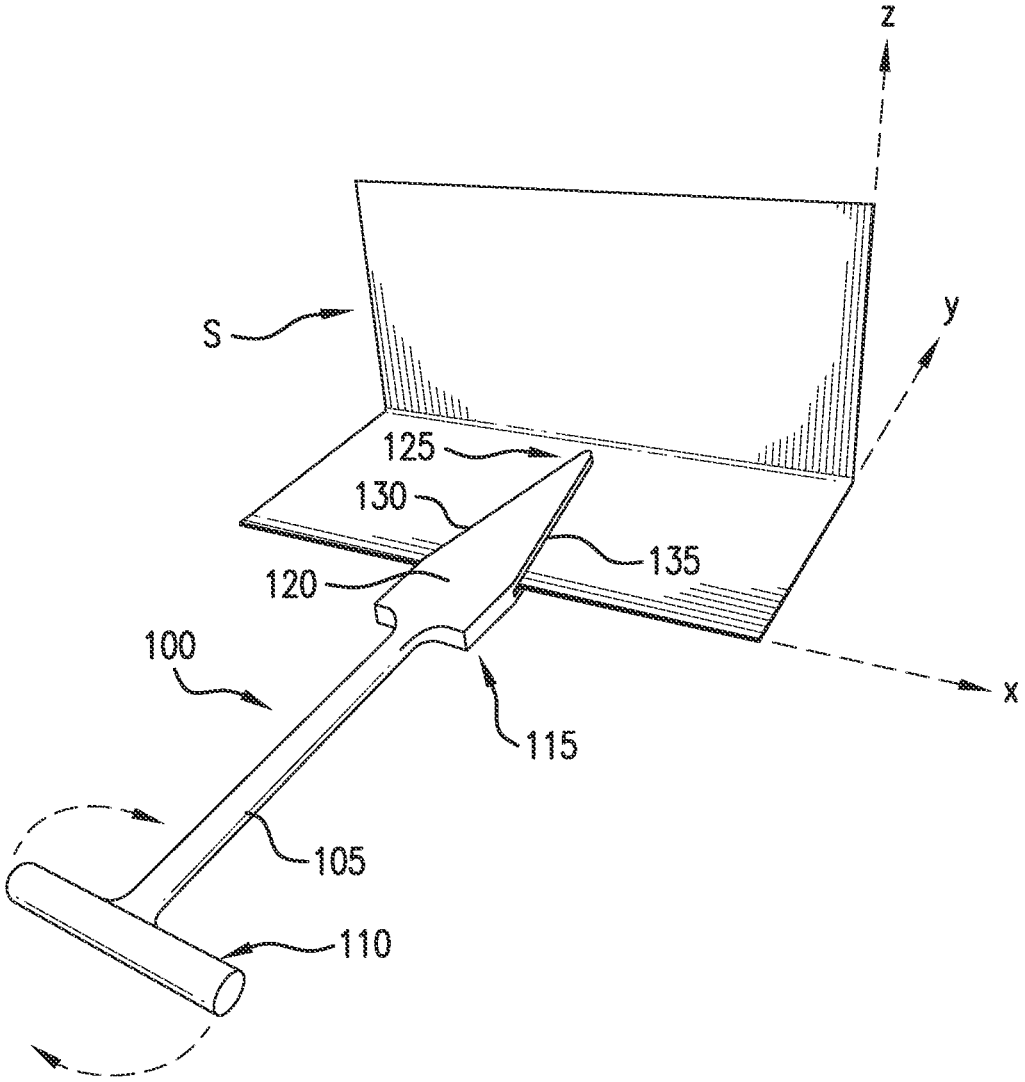
FIG. 1 illustrates a top view of a flashing tool according to one embodiment, engaged with stock flashing material.

FIG. 1 shows a top view of a flashing tool 100 according to one non-limiting embodiment. In this embodiment, the flashing tool 100 includes an elongate rod 105 having a handle portion 110 and a forming portion 115 on opposite end portions, respectively. In this embodiment, the handle portion 110 is provided as a "T" shaped handle as shown; however, other handle conformations can be utilized as desired. Without limitation, the T-shaped handle may provide a mechanical advantage as, in this embodiment, the flashing tool 100 is configured to be twisted about the elongate axis of rod 105 as explained in greater detail below.

Figure 2:
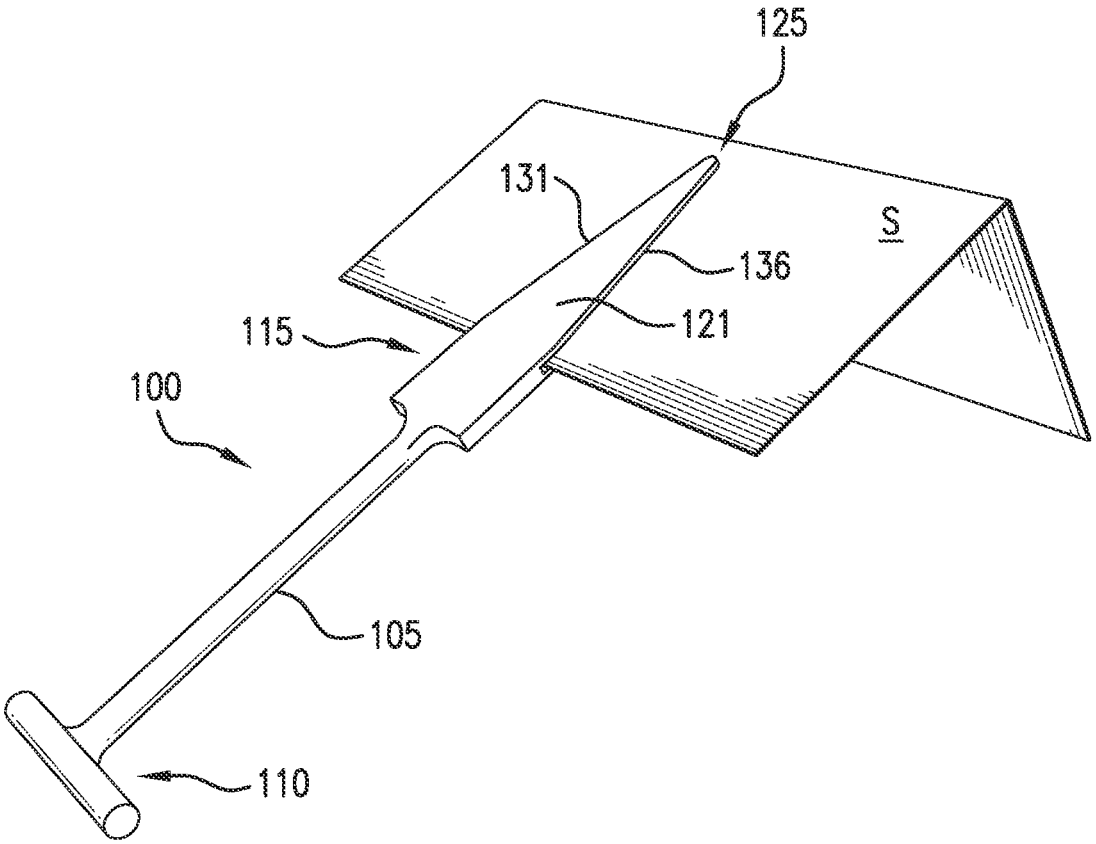
FIG. 2 illustrates a bottom view of a flashing tool according to one embodiment, engaged with stock flashing material.

In this embodiment, forming portion 115 includes a top spade 120 and a bottom spade 121 (FIG. 2) symmetrically disposed one atop the other and having a gap therebetween. (While the gap is not explicitly shown in FIGS. 1-2, its presence is derived by stock material S being shown interposed between top (120) and bottom (121) spades in FIGS. 1-2.) Each of the top (120) and bottom (121) spades includes a left and right edge; for example, top spade 120 includes left (130) and right (135) edges; bottom spade 121 includes left (136) and right (131) edges. In this embodiment, the left and right sides of the top (120) and bottom (121) spades converge at tip 125. In general, the gap between top (120) and bottom (121) spades can be slightly larger than the thickness of flashing stock material S being used, or as desired.

Flashing tool 100 can be used to form flashing, in particular, kick-out flashing. While the present example shows the formation of kick-out flashing, it should be understood that any other type of flashing can be formed with flashing tool 100. To form kick-out flashing, a user can begin with a piece of stock material S. In this embodiment, stock material S is galvanized steel; however, any other desired material can be utilized. In this example, if the stock material S is not already pre-formed as a right angle, a user can place a bend that bisects the length of stock material S as shown. Some stock material S is available pre-formed in a right-angle configuration.

Referring to FIG. 1 in particular, in this example, the user can insert the stock material S into the gap of the flashing tool 100. Placement of the flashing tool 100 relative to the horizontal axis x as illustrated in FIG. 1 can determine the placement of the kick-out angle as described in greater detail below. In general, it can be advantageous to position tip 125 adjacent, or near to the right-angle fold of the stock material S as shown.

Figure 3:
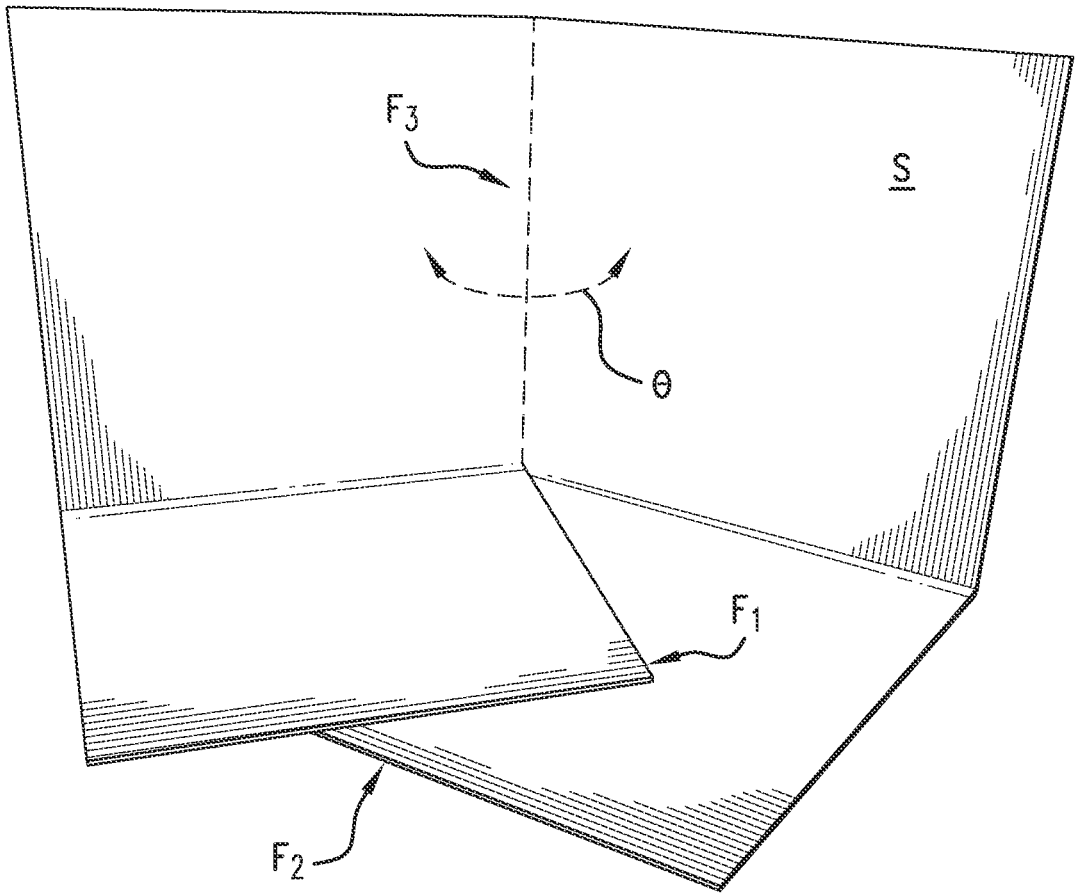
FIG. 3 illustrates a kick-out flashing component formed by the flashing tool of FIGS. 1 and 2.

With the flashing tool 100 positioned in the conformation as shown in FIG. 1, the user can execute a 180-degree twist of the flashing tool 100 in clockwise or counter-clockwise directions. Referring to FIGS. 1 and 3, in this example, the twisting motion is executed clockwise as illustrated by the dashed arrows proximal to handle portion 110 in FIG. 1. In doing so, referring to FIG. 3, an S-fold is created in the horizontal portion (the x-y plane) of stock material S that includes fold $F_1$ and $F_2$, and, naturally a third fold $F_3$ is created in the vertical portion (the x-z plane) of stock material S at an angle θ.

Because the flashing tool 100 was rotated in a clockwise direction, fold $F_1$ derives from edge 130 and fold $F_2$ derives in part from edge 135 of the forming portion 115. It should be evident that, had the user twisted the flashing tool 100 in a counter-clockwise direction, that the S-fold would be in the opposite conformation. Such flexibility allows the user to determine which S-fold conformation is optimal for the direction of the kick-out flashing, taking water runoff direction and other factors into account. In this and other embodiments, the S-fold can be easily flattened to a minimum profile using, e.g., a hammer. It should be understood that the flashing tool 100 need not be rotated exactly 180 degrees to form the S-fold.

In this and other embodiments, the kick-out angle θ formed by the flashing tool 100 can be determined by the greatest distance between left and right edges (e.g., edges 130 and 135) of the top (120) and bottom (121) spades. In general, a smaller distance between edges will result in a smaller angle θ and vice-versa.

Figure 4:
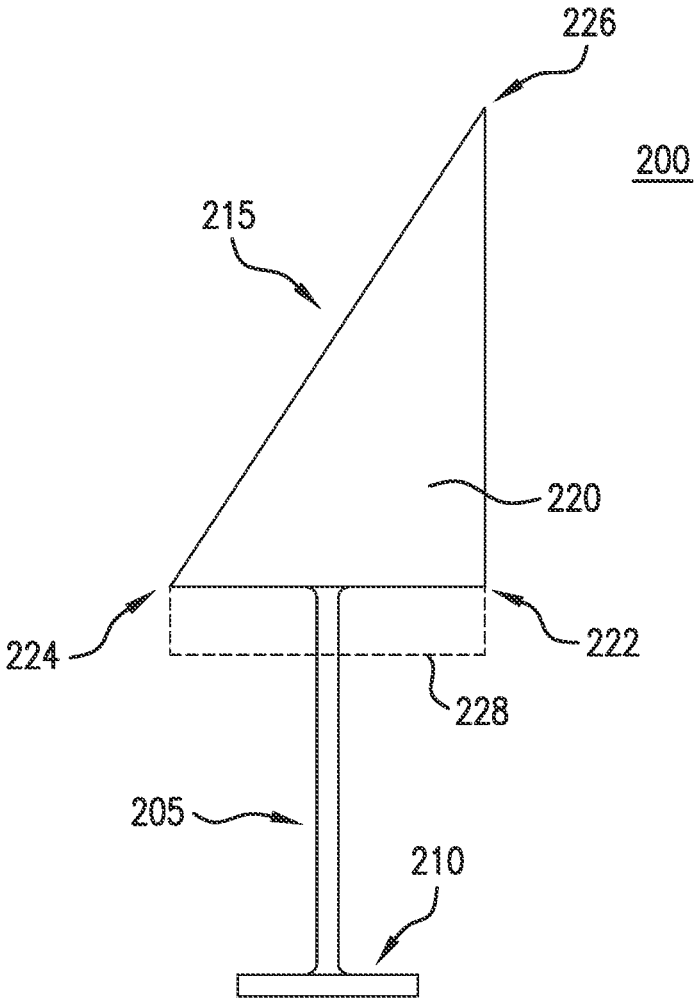
FIG. 4 is a flashing tool according to one embodiment.

Referring now to FIG. 4, a top view of a flashing tool 200 is shown according to one alternative embodiment. In this embodiment, like flashing tool 100, flashing tool 200 includes an elongate rod 205 joined with a handle portion 210 in a "T" configuration. In this embodiment, the flashing tool 200 includes a forming portion 215 that itself includes two right triangle plates 220 positioned one atop the other and having a gap therebetween sufficient to receive a portion of flashing material. It should be understood that FIG. 4 is a top plan view of flashing tool 200 and therefore only the top right triangle plate 220 is shown for figure clarity. A bottom right triangle plate of equal dimensions is disposed directly beneath and aligned with top right triangle plate 220.

In this embodiment, the forming portion 215 includes three angles, 222, 224 and 226, wherein, in this embodiment, angle 222 is a ninety-degree right angle. Dashed line 228 illustrates an alternative embodiment, wherein the bottom portion of forming portion 215 includes additional area (bounded by the dashed line) that can be useful in creating custom folds of flashing stock.

Like flashing tool 100, the top (220) and bottom plates of the forming portion 215 are separated by a gap that is sufficient to receive a portion of flashing stock. In this and other embodiments, the gap may be set so as to receive a single ply of flashing stock between top and bottom plates of the forming portion 215. For example, and without limitation, the gap between top and bottom plates can be between 0.010 inches and 0.02 inches, which may be suitable for residential flashing stock. For industrial applications, the plate gap can be between 0.020 and 0.030 inches, without limitation, to allow receiving thicker flashing stock. In some embodiments, the plate gap can be set to receive two or more stacked flashing stock pieces. For example, for residential applications, the plate gap can be 0.040 inches to allow two flashing pieces to be bent at one time.

In general, forming portion 115 and 215 provide for receiving a portion of flat flashing stock that, when rotated after receiving the flat flashing stock, imparts a kick-out angle to the flashing stock. The flashing stock can then be used as a kick-out flashing piece and installed on a roof, for example.

A number of illustrative embodiments have been described. Nevertheless, it will be understood that various modifications may be made without departing from the spirit and scope of the various embodiments presented herein. For example, forming portion 115 can be reversibly-attachable to rod 105, allowing different spade sizes to be utilized for forming various kick-out angles θ; rod 105 can be substantially flat, providing an edge surface for forming the right-angle fold in otherwise flat stock material. Accordingly, other embodiments are within the scope of the following claims.

What is claimed is:

1. A tool for forming an S-fold in flashing, comprising:

an elongate rod member;

a handle member disposed on a first end of said rod member; and a forming member on a second end of said rod member opposite the first end;

wherein said forming member comprises:

first and second flat plate members symmetrically disposed and fixed one atop the other and having a gap therebetween;

wherein each of said first and second flat plate members comprise a first edge and a second edge, each of said first and said second edges meeting at a corner, wherein said first and said second edges and corner are configured to impart said S-fold in said flashing.

2. The tool of claim 1, wherein each of said first and said second forming members is spade shaped.

3. The tool of claim 1, wherein each of said first and said second forming members is shaped as a right triangle.

4. The tool of claim 1, wherein said gap is between 0.010 inches and 0.020 inches.

5. The tool of claim 1, wherein said gap is between 0.020 inches and 0.040 inches.

6. The tool of claim 1, wherein said handle member and said elongate rod member are configured in a T-shape.

7. A method for manually creating kick-out flashing, comprising:

providing the tool of claim 1;

placing a portion of flashing stock between said first and second flat plate members of said tool;

rotating said tool so as to create an S-fold in said flashing stock;

wherein an amount of rotation determines a kick-out angle of said kick-out flashing.

8. The method of claim 7, wherein said kick-out angle is in part determined by a distance between said first edge and said second edge of said first and said second plate members, respectively.

* * * * *